US008490831B1

(12) United States Patent
Wong et al.

(10) Patent No.: US 8,490,831 B1
(45) Date of Patent: Jul. 23, 2013

(54) FLOATING, SQUIRTING TOY INCLUDING BELLOWS, AND METHODS THEREOF

(71) Applicant: Easebon Services Limited, Hong Kong (CN)

(72) Inventors: Veronica Pui Chung Wong, Hong Kong (CN); Boguslaw Orlowski, Oceanside, CA (US)

(73) Assignee: Easebon Services Limited, Hong Kong (HK)

( * ) Notice: Subject to any disclaimer, the term of this patent is extended or adjusted under 35 U.S.C. 154(b) by 0 days.

(21) Appl. No.: 13/800,881

(22) Filed: Mar. 13, 2013

Related U.S. Application Data

(63) Continuation-in-part of application No. 13/295,281, filed on Nov. 14, 2011, which is a continuation of application No. 12/018,691, filed on Jan. 23, 2008, now Pat. No. 8,123,077, which is a continuation-in-part of application No. 11/860,617, filed on Sep. 25, 2007, now Pat. No. 7,571,837, which is a continuation of application No. 10/942,326, filed on Sep. 16, 2004, now Pat. No. 7,281,642.

(51) Int. Cl.
*A63H 3/18* (2006.01)

(52) U.S. Cl.
USPC ..... 222/79; 446/153

(58) Field of Classification Search
USPC ..... 222/79, 366, 212, 409, 386, 518, 222/513, 511; 446/153, 473, 475; 92/146, 92/245
See application file for complete search history.

(56) References Cited

U.S. PATENT DOCUMENTS

| | | | | | |
|---|---|---|---|---|---|
| 1,394,456 | A | * | 10/1921 | Wanat | 446/192 |
| 3,299,891 | A | * | 1/1967 | Smeton | 604/232 |
| 5,256,099 | A | * | 10/1993 | Rudell et al. | 446/473 |
| 5,992,697 | A | * | 11/1999 | James | 222/175 |
| 6,027,393 | A | * | 2/2000 | O'Rourke | 446/153 |
| 2002/0102912 | A1 | * | 8/2002 | Duval | 446/486 |
| 2009/0145930 | A1 | * | 6/2009 | Chen | 222/214 |
| 2009/0176439 | A1 | * | 7/2009 | Chen | 446/153 |
| 2011/0097963 | A1 | * | 4/2011 | Chen | 446/71 |

FOREIGN PATENT DOCUMENTS

| | | | | |
|---|---|---|---|---|
| CA | 2190207 | * | 5/1998 | 446/153 |

* cited by examiner

*Primary Examiner* — Lien Ngo
(74) *Attorney, Agent, or Firm* — Amster, Rothstein & Ebenstein LLP

(57) ABSTRACT

A squirting toy is comprised of a cylindrical housing and a piston that slides within to force water into or out of the housing via a hole therein. The housing is encased within a shell creating a water impervious volume sufficient for the toy to float in water. The shell is soft, so that the gun is not a safety hazard when left floating in a swimming pool. The squirting toy can further include bellows that can provide safety benefits as well as other benefits.

18 Claims, 12 Drawing Sheets

FLOATING, SQUIRTING TOY INCLUDING BELLOWS, AND METHODS THEREOF

CROSS REFERENCE TO RELATED APPLICATION

This application is a continuation-in-part of U.S. application Ser. No. 13/295,281, filed Nov. 14, 2011, pending, the contents of which are incorporated herein by reference in their entirety, which is a continuation of U.S. application Ser. No. 12/018,691, filed Jan. 23, 2008, now U.S. Pat. No. 8,123,077, issued Feb. 28, 2012, the contents of which are incorporated herein by reference in their entirety, which is a continuation-in-part of U.S. patent application Ser. No. 11/860,617 filed on Sep. 25, 2007, now U.S. Pat. No. 7,571,837, issued Aug. 11, 2009, the contents of which are incorporated by reference herein in their entirety, which application is a continuation of U.S. application Ser. No. 10/942,326, filed Sep. 16, 2004, now U.S. Pat. No. 7,281,642, issued Oct. 16, 2007, the contents of which are incorporated herein by reference in their entirety, for which priority is claimed under 35 U.S.C. §120.

FIELD OF THE INVENTION

The present invention relates to a floating squirting toy including bellows.

BACKGROUND AND OBJECTS OF THE INVENTION

Squirt guns are well known in many forms in the prior art. Numerous squirt guns and squirting toys are made and have been made over the years for use by persons while swimming in or standing adjacent to a swimming pool, which are adapted to quickly take in water from the swimming pool for squirting. One such toy is called Water Stix™ and is sold by Hearthsong Inc. This toy, representative of many such squirting toys, is basically comprised of a housing having a nozzle at its squirting end. A piston, which includes a graspable handle, is adapted to slide within the housing so that, when the nozzle end of the housing is submerged in the pool and the piston is pulled backwards, water is drawn into the housing through the nozzle. And when the piston is subsequently forced forwardly, that water is forced from the housing, through the nozzle, towards a target, in a powerful stream.

Additionally, many squirt guns of the prior art are constructed in a manner that entraps air and thereby inadvertently enables those guns to partially float in water. The degree of such buoyancy is relative to the amount of water that has been taken into the gun and the longevity of such buoyancy is relative to the to the amount of air leakage from the housing.

There are also floating toy "swimming noodles" in the prior art, which are made of resilient floating closed-cell polymer foam. These toys are used to provide buoyancy to the user while swimming. Because these toys are often left floating in the pool when not in use, their softness eliminates the safety threat that they would otherwise pose.

It is therefore an object of the present invention to provide an improved squirting toy that floats fully atop the surface of the water, whether filled with or empty of water.

It is a further object to provide a soft squirting toy that is safer that squirting toys of the prior art.

It is a further object to provide a squirting toy that is both buoyant and soft.

It is a further object to provide such a squirting toy that has a similar appearance to a "swimming noodle".

In a preferred embodiment, the floating, squirting toy comprises a housing having a chamber, the chamber having a variable volume defined by a first chamber end, a second chamber end and a interior surface, a hole through the housing adjacent the first chamber end allows communication between the chamber and the outside environment; a piston disposed adjacent the second chamber end, the piston being sealingly engaged with the chamber interior surface and adapted for longitudinal movement within the housing to vary the volume of the chamber; a shaft attached to the piston and having a portion extending out of the housing, the shaft portion extending out of the housing having a first handle attached thereto; an outer shell disposed over the housing, the shell creating a water impervious volume imparting a buoyancy sufficient to keep the toy afloat in water; and a second handle attached to one of either the shell or the housing. The toy is adapted to inhale water through the hole while the hole is submerged during the expansion of the chamber using the handles, and the toy being adapted to exhale the water through the hole during the contraction of the chamber using the handles. The outer shell may be chosen from one of a transparent, translucent material or a polymeric foam. The cross-sectional shape over a substantial portion of the outer shell may be chosen from at least one of round, polygonal, elliptical, oval, fanciful animal-like and some combination of shapes including generally polygonal with rounded sides.

Further objects and advantages of the invention will be apparent upon a review of the following description and drawings of the invention, including the preferred embodiment thereof.

SUMMARY OF THE INVENTION

The present invention comprises a squirting toy that is housed within a polyethylene (PE) closed cell foam shell. The closed cell shell is non-absorbing, so that the foam remains buoyant and keeps the gun afloat indefinitely. The foam is soft, so that the toy is not a safety hazard when left floating in a swimming pool. In the preferred embodiment, the squirting toy is comprised of a cylindrical housing and a piston that slides within to force water into or out of the housing via a hole therein. The foam shell of the preferred embodiment is similar in size and shape to a "swimming noodle", and is therefore more attractive to a child who is familiar with such. The present invention also encompasses a shell of a shapes dissimilar to traditional "swimming noodles". What is important is that there is sufficient material in the shell to provide buoyancy, i.e. the toy to floats when it is filled with water, and that the shell is soft, i.e. does not present a safety hazard when floating in the water.

In exemplary embodiments, a floating squirting toy can include a housing having a chamber and an opening, the opening can allow fluid communication between the chamber and the outside environment, and the chamber can include an interior wall. Further, the squirting toy can include a shaft having a first portion inside of the chamber attached to a piston and a second portion outside of the chamber attached to a handle. The piston can be slidably engaged with the interior wall of the chamber and can be adapted for longitudinal movement within the chamber to decrease and increase the volume of the chamber such that water is inhaled through the opening when the volume increases and exhaled through the opening when the volume decreases. The squirting toy can include on at least a portion of the housing and/or the handle at least one outer shell that can provide safety benefits by (i) being constructed of a resilient closed-cell polymer foam material that is substantially soft and/or (ii) being constructed such that the at least one outer shell contributes to a buoyancy that causes the floating squirting toy to remain afloat when the chamber is completely filled with water. Further still, the squirting toy can include at least one bellows that can extend over at least a portion of the housing and/or the shaft.

In exemplary embodiments, the at least one bellows can provide safety benefits by blocking a child's fingers from getting caught, pinched, and/or injured when decreasing the volume of the chamber to exhale water from the floating squirting toy.

In exemplary embodiments, the at least one bellows can extend over at least a portion of both the housing and the shaft.

In exemplary embodiments, the at least one bellows can extend from a shell on at least a portion of the housing and/or the housing to a shell on at least a portion of the handle.

In exemplary embodiments, the at least one outer shell can be constructed of a plurality of substantially soft resilient closed-cell polymer outer shells on a length of at least one of the housing and the handle.

In exemplary embodiments, the at least one substantially soft resilient closed-cell polymer foam outer shell can be constructed in a cylindrical shape.

In exemplary embodiments, the at least one cylindrically shaped substantially soft resilient closed-cell polymer foam outer shell can have a cross-sectional shape that can be round, polygonal, elliptical, oval, and/or some combination of shapes including generally polygonal with rounded sides.

In exemplary embodiments, the at least one substantially soft resilient closed-cell polymer foam outer shell can be constructed to at least one of the size and shape of an at least one swimming noodle.

In exemplary embodiments, the at least one substantially soft resilient closed-cell polymer foam outer shell can be constructed to have a length dimension that can be substantially equal to a length of the housing and/or a length of the handle.

In exemplary embodiments, the at least one substantially soft resilient closed-cell polymer foam outer shell can be constructed to have a length dimension that is substantially smaller than a length of the housing and/or a length of the handle.

In exemplary embodiments, a floating squirting toy can include a housing having a chamber, the housing can include an interior surface and an exterior surface, a first end including an opening, and a second end including an opening. Further, the squirting toy can include a piston that can be slidably engaged with the interior surface of the housing and connected to a shaft. The shaft can extend from the second end of the housing and can include a handle portion external to the housing. The piston can be adapted for longitudinal movement within the chamber to decrease and increase the volume of the chamber such that water is inhaled through the first end when the volume increases and exhaled through the first end when the volume decreases. A soft non-water-absorbing shell can be disposed over a portion of the external surface of the housing. Further still, the floating squirting toy can include at least one bellows disposed over at least a portion of the housing and/or the shaft.

In exemplary embodiments, the at least one bellows can provide safety benefits by substantially blocking a child's fingers from getting caught, pinched, and/or injured when decreasing the volume of the chamber to exhale water from the floating squirting toy.

In exemplary embodiments, the at least one bellows can be disposed over at least a portion of both the housing and the shaft.

In exemplary embodiments, the at least one bellows can extend from the soft non-water absorbing shell disposed over a portion of the housing to the handle.

In exemplary embodiments, the soft non-water-absorbing shell can provide buoyancy to keep the toy afloat in water when the housing is filled to its maximum capacity with water; can form a protective surface over at least a portion of the housing; and/or the softness of the shell can offer safety benefits.

In exemplary embodiments, the soft non-water-absorbing shell can be disposed over substantially the entirety of the housing.

In exemplary embodiments, a soft non-water-absorbing shell can be disposed over a portion of the handle portion.

In exemplary embodiments, the safety benefits can comprise softness and/or absence of hard edges.

A more complete understanding of the invention will be realized upon review of the following description and drawings of preferred embodiments of the invention.

BRIEF DESCRIPTION OF THE DRAWINGS

FIG. 1 is an action view of a squirting toy showing water being expelled there-from;

DETAILED DESCRIPTION OF THE PREFERRED EMBODIMENT

A preferred embodiment of the invention is shown in FIGS. 1 through 5, where there is depicted a toy 100 for squirting a water stream 102, and which is adapted to float on the water surface 104.

Figure 1:
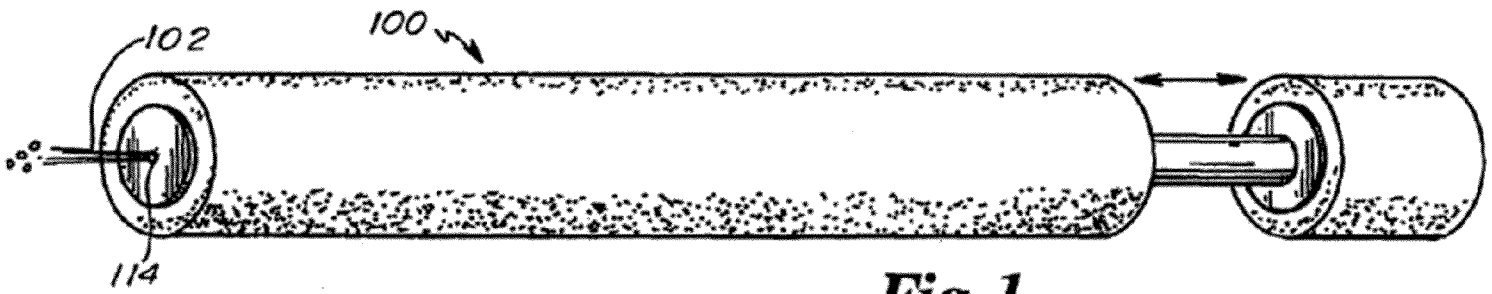
Figure 2:
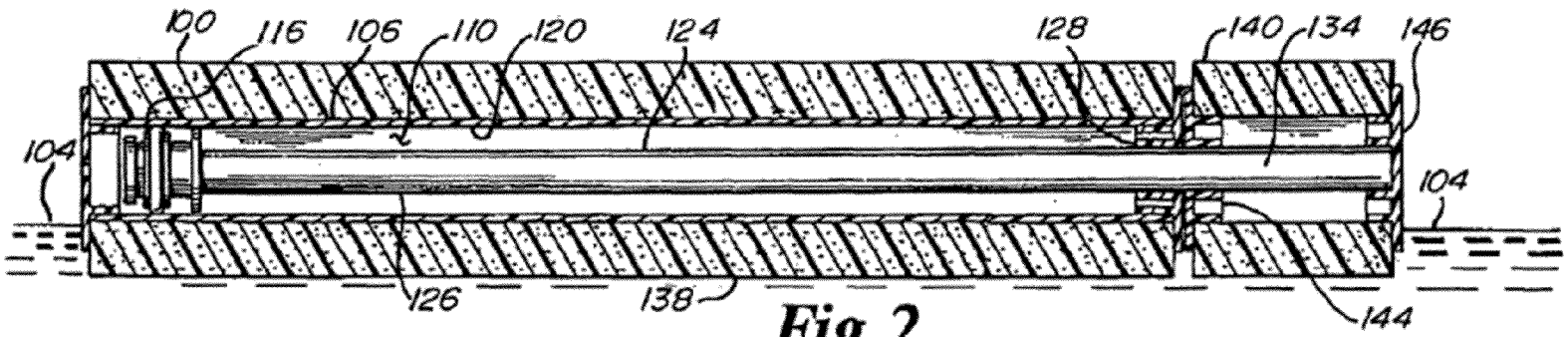
FIG. 2 is a cross-sectional view through the toy of FIG. 1 in its retracted/empty state.
Figure 3:
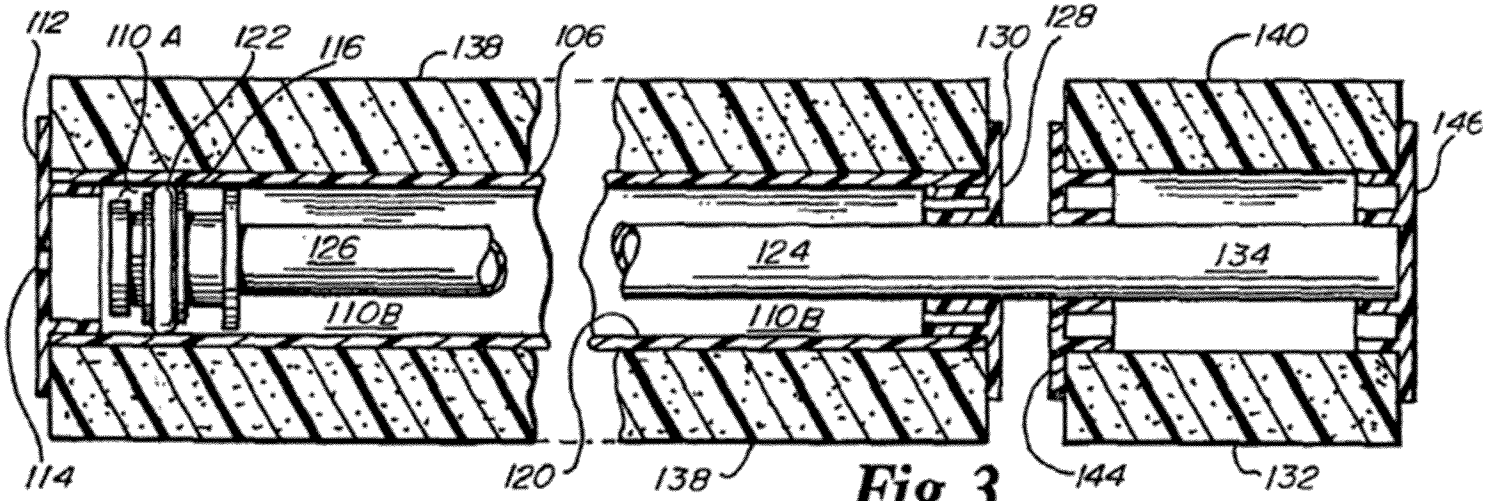
FIG. 3 is an enlarged partial section of the toy of FIG. 1.
Figure 4:
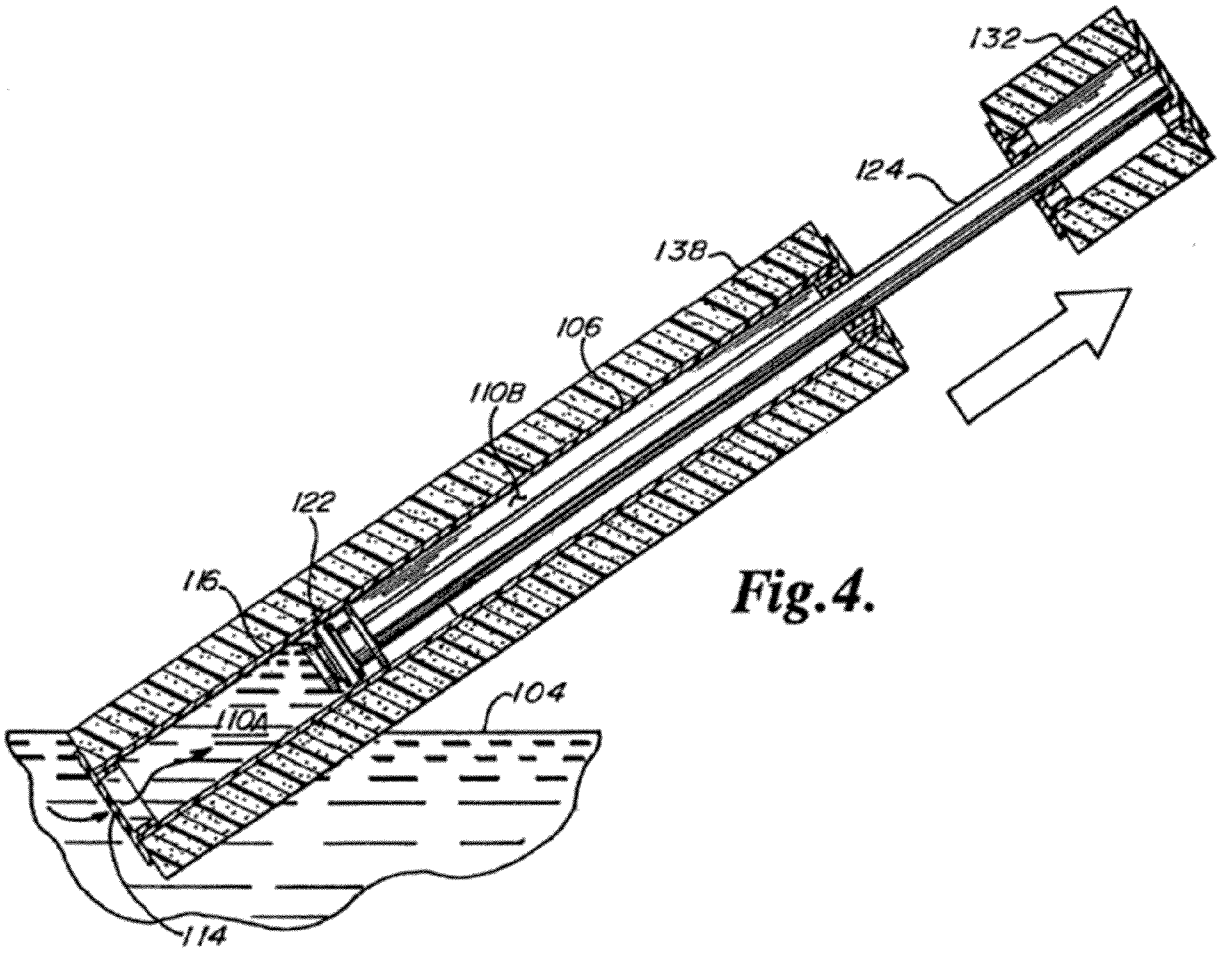
FIG. 4 is an action cross-sectional view showing the intake of water into the toy of FIG. 1.
Figure 5:
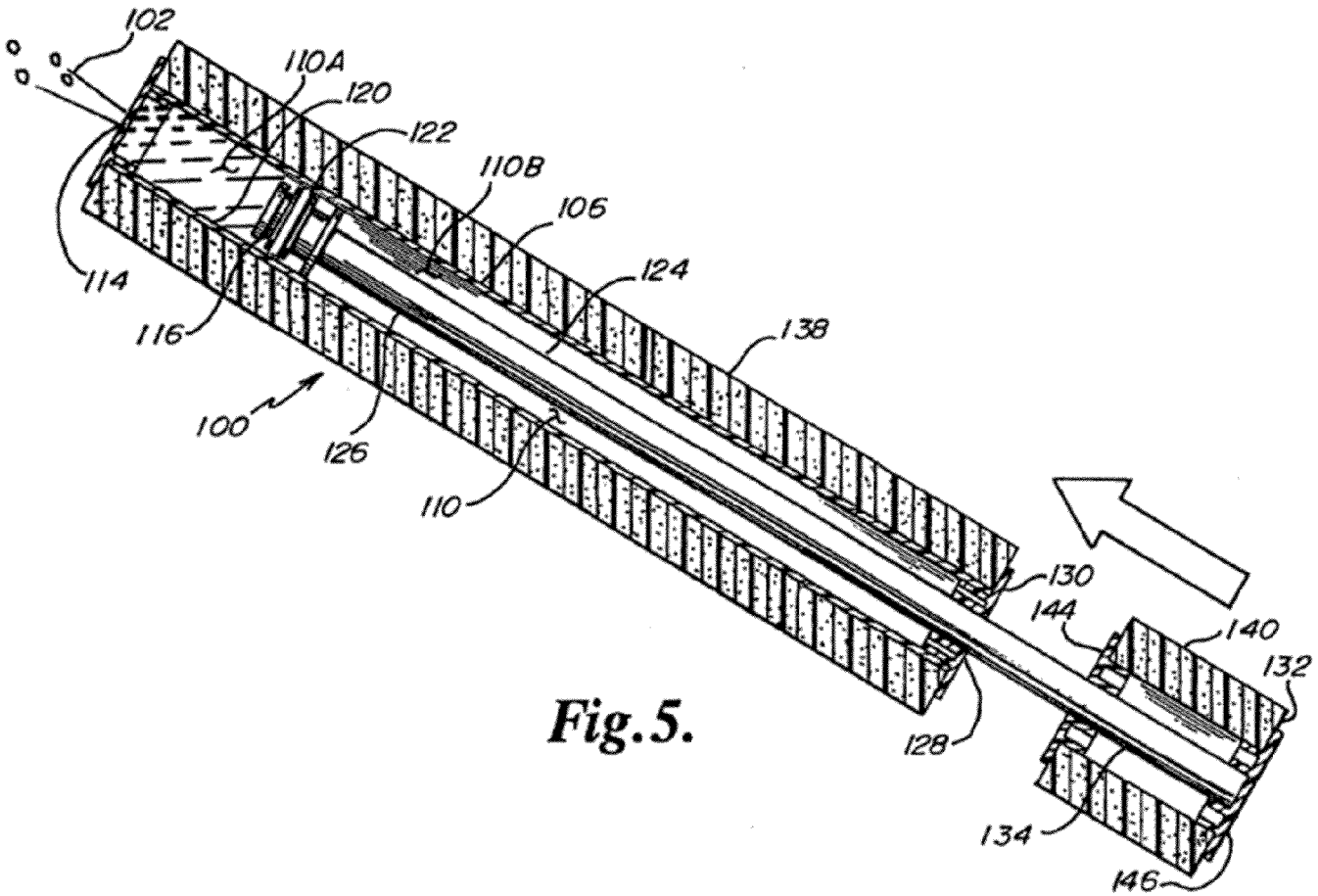
FIG. 5 is an action cross-sectional view showing the expulsion of water from the toy of FIG. 1.

The toy 100 comprises a rigid tubular housing 106 that encloses a hollow cylindrical chamber 110. The forward end 112 of the tubular housing is closed except for a small hole 114. Piston 116 slides longitudinally within chamber 110 and is sealed against the cylindrical inner surface 120 of the chamber by o-ring 122, which is seated within groove 125 of the piston. The piston separates the chamber 110 into a forward portion 110A and a rear portion 110B. The piston 116 is rigidly connected to shaft 124 at the forward end 126 thereof. Slide bushing 128 supports shaft 124 at the rear end 130 of the tubular housing 106, while allowing longitudinal movement relative thereto. Handle portion 132 is rigidly connected to shaft 124 at the rearward end 134 thereof. Expansion of the handle portion 132 relative to the tubular housing 106, while hole 114 is below the water surface 104, as depicted in FIG. 4, causes water to be inhaled into the expanding forward chamber portion 110A, through hole 114. Subsequent retraction of the handle portion 132 relative to the tubular housing 106 causes that water to be exhaled through hole 114 in a powerful stream 102.

Tubular shell 138, preferably made of closed-cell polyethylene foam, surrounds tubular housing 106, to provide both a soft protective surface and buoyancy. Other materials may be substituted for polyethylene foam, such as ethylene vinyl acetate closed-cell foam.

Figure 8:
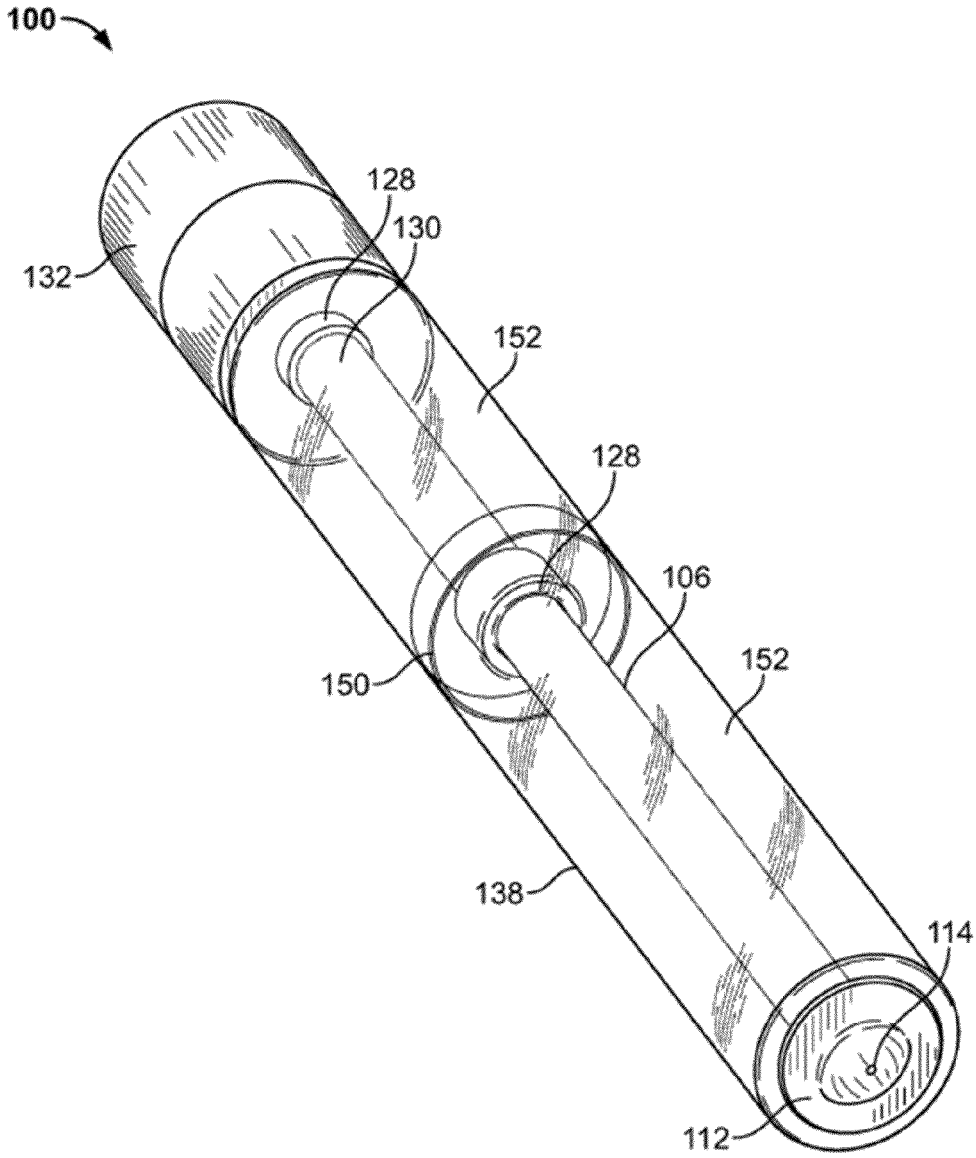
FIG. 8 is a side perspective view of an embodiment of the squirting toy of the present invention.
Figure 9:
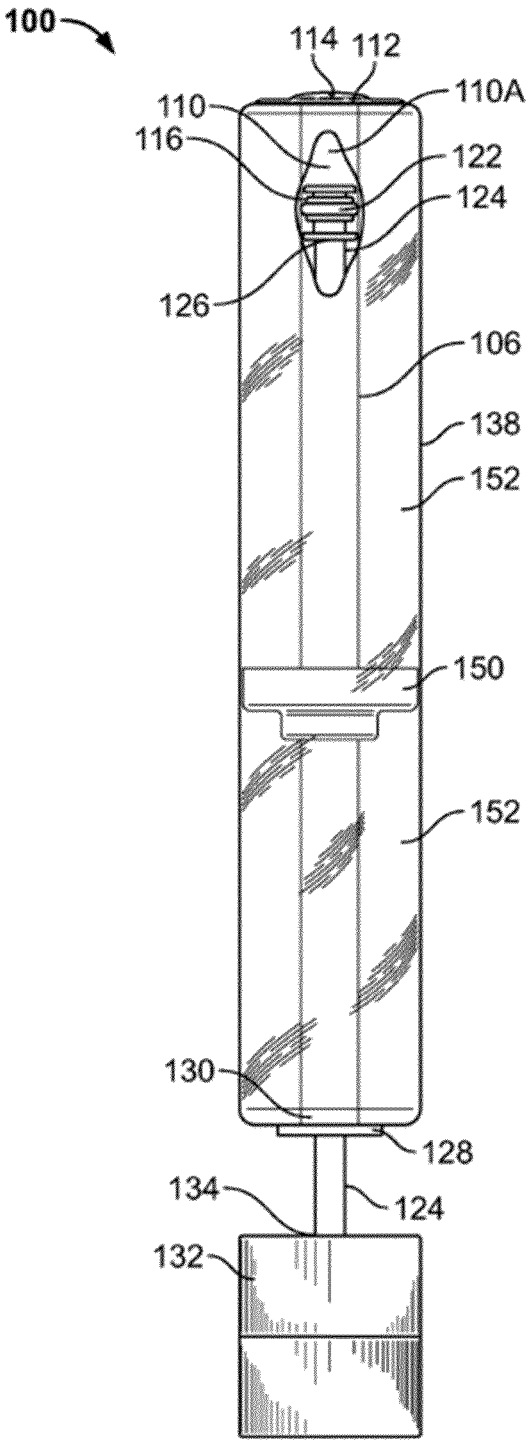
FIG. 9 is a side elevation view of the squirting toy embodiment of FIG. 8 showing a section view of tubular housing containing piston 116 and handle portion 132 separated a distance from shell 138.
Figure 10:
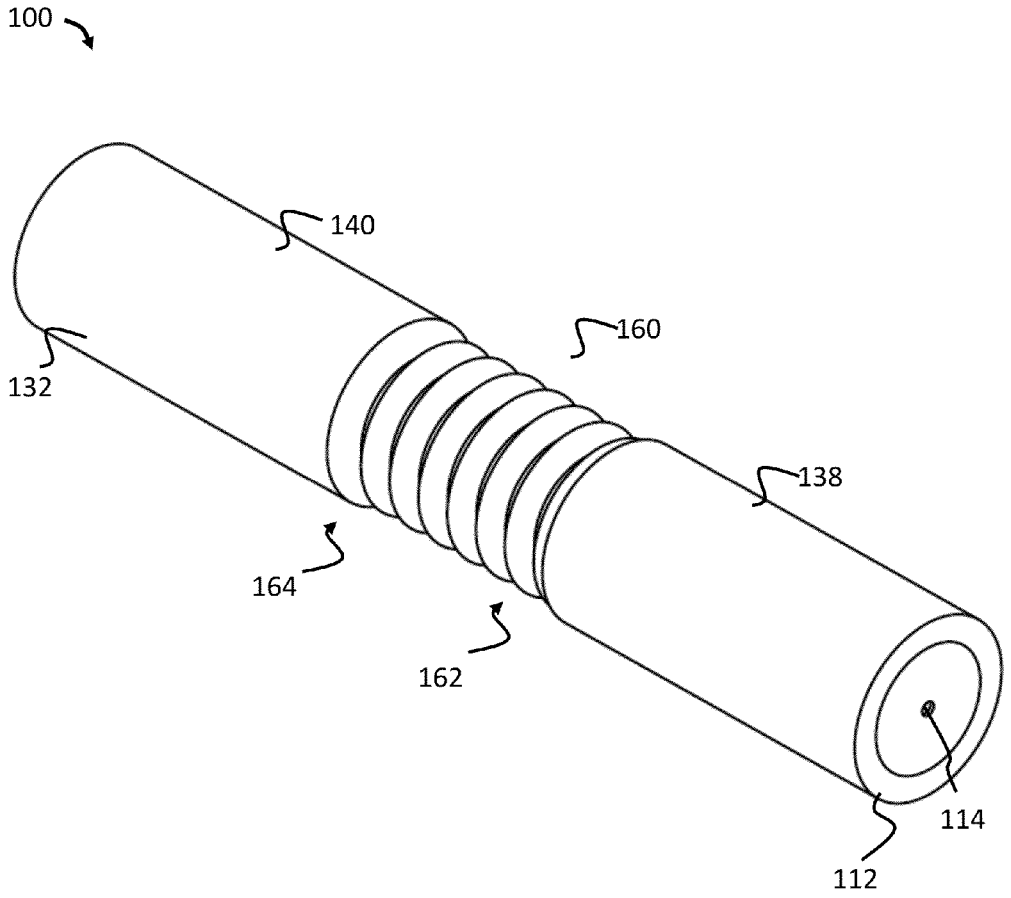
FIG. 10 is a side perspective view of embodiments of the squirting toy of the present invention.
Figure 11:
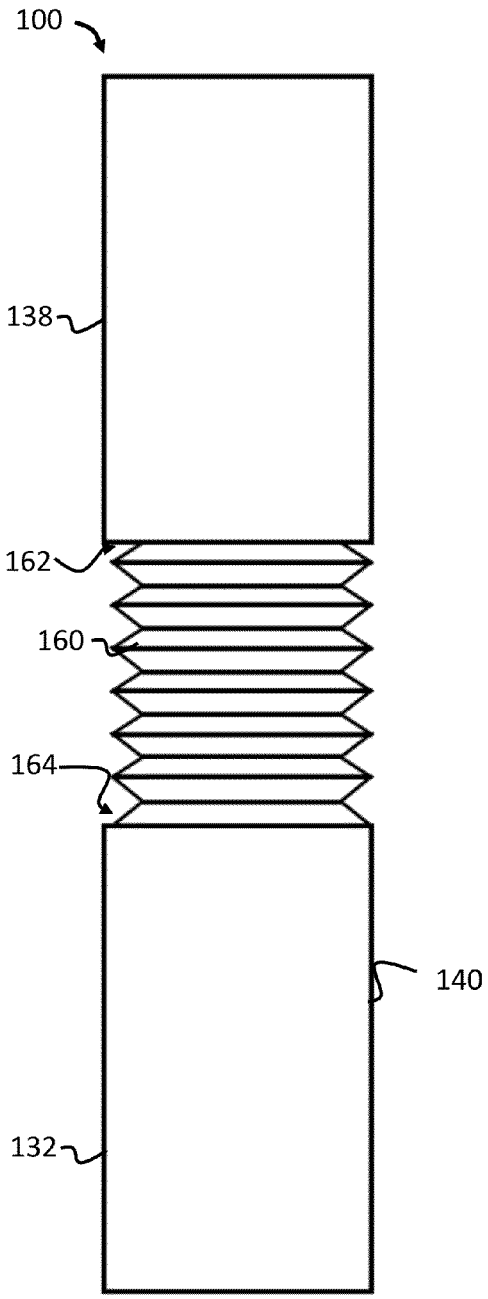
FIGS. 11-12 are expanded and contracted configurations of embodiments of the squirting toy of the present invention.
Figure 12:
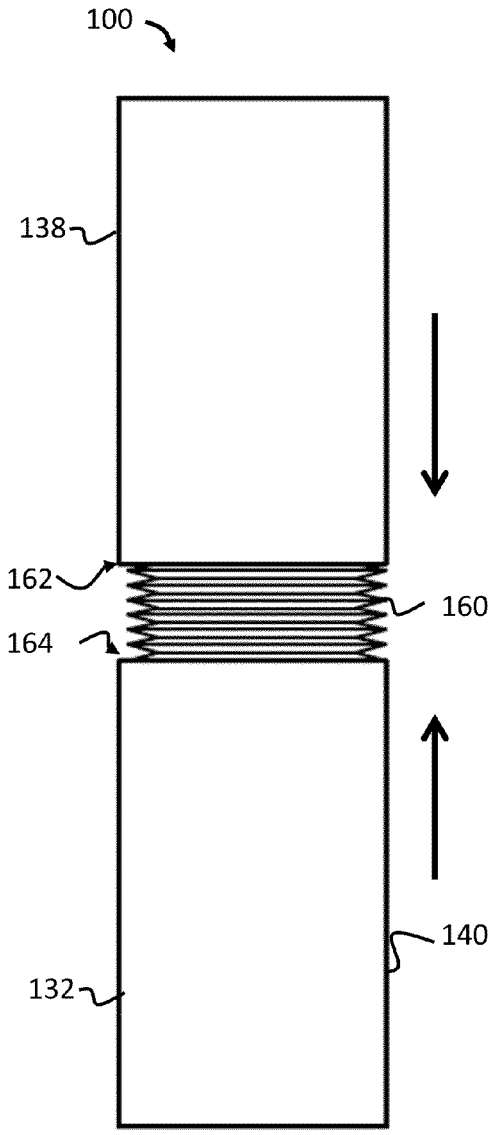
Figure 13:
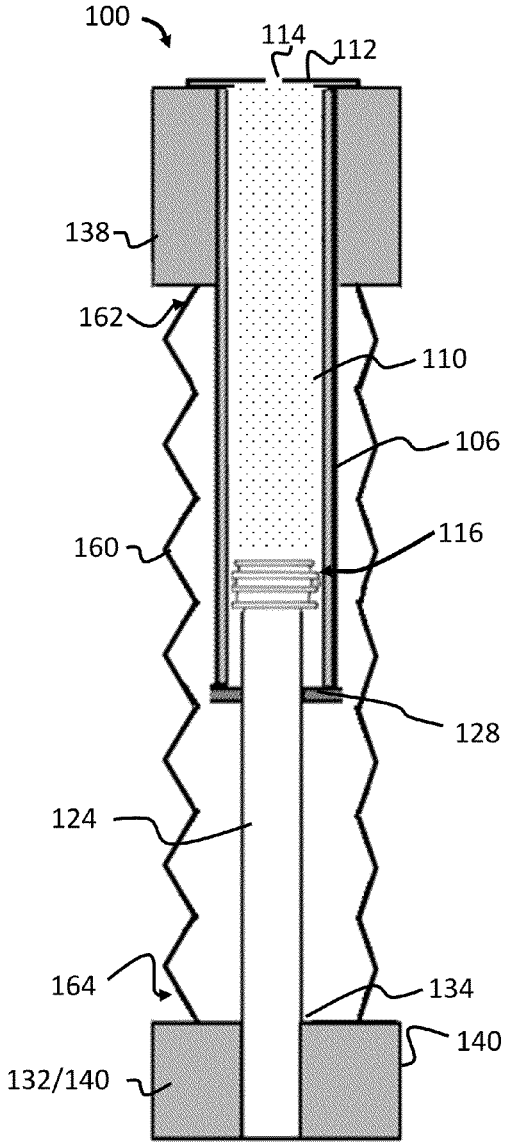
FIGS. 13-16 are cross-sectional views of expanded and contracted configurations of embodiments of the squirting toy of the present invention.
Figure 14:
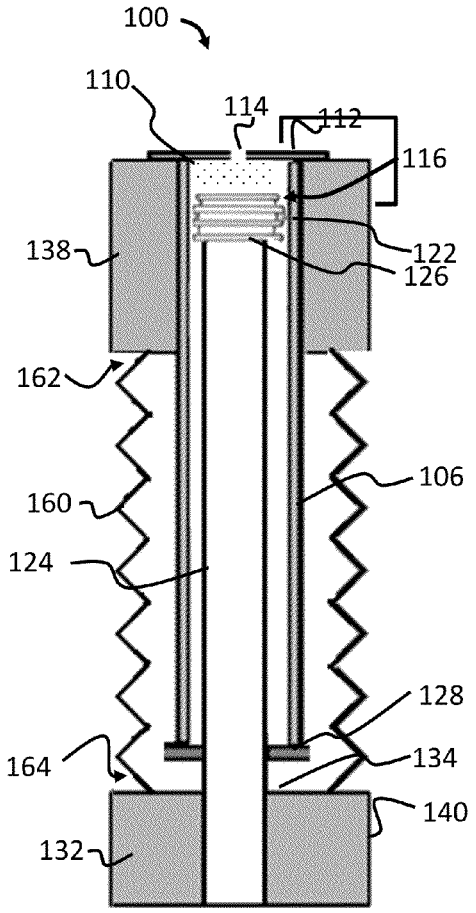

FIGS. 8 and 9 show an alternative embodiment of the squirting toy invention. The encapsulating shell 138 of FIG. 9 is a thin material, e.g. a polymer, that defines a toroidal space between an inside surface of the encapsulating shell 138 and the outside surface of housing 106. Encapsulating shell 138 prevents water from entering toroidal space 152 and provides buoyancy when toy 100 is in a pool or other body or water even when housing 106 is filled with liquid.

In a most preferred embodiment, encapsulating shell 138 is formed from a material and of wall thickness to provide flexibility and 'softness' to the encapsulating shell. Examples of such materials include polyethylene terephthalate (PET or PETE), low density polyethylene (LDPE), high density polyethylene (HDPE). Materials and wall thickness parameters similar to those of standard carbonated beverage bottles will provide sufficient 'softness' to form a safe squirting toy, i.e. the toy 100 having encapsulating shell 138 of the most preferred embodiment will not injure a person hit with the toy at typical velocities. Encapsulating shell 138 may be supported at one or more points along its length by a shell support 150. Alternatively, a much thinner wall thickness may be chosen and the toroidal space slightly pressurized. Proper choice of pressure will result in encapsulating shell 138 maintaining a selected 3-dimensional shape while remaining soft enough to offer safety benefits.

In another preferred embodiment of the squirting toy, encapsulating shell 138 may be transparent, semi-transparent or translucent. Such a preferred embodiment is shown in FIGS. 8 and 9.

Handle portion 132 may include handle shell 140, which is preferable made of the same foam, and is rigidly connected shaft 124 by means of support bushings 144 and 146. Alternatively, other materials having sufficient buoyancy, softness, and water impermeability, such as polyurethane foam, may be used for both the tubular and handle shells. The shells may also be blow molded or rotationally molded air-filled cylindrical bladders or similar materials, as illustrated by encapsulating shell 32 in FIGS. 8 and 9. The handle shell 140 may also be made of solid material as long as sufficient buoyancy is provided by the tubular shell.

A most preferred embodiment of the present invention has the squirting toy emulating a "swimming noodle", well known in the context of recreational water activities. When the handle portion is retracted, as in FIG. 2, the shell 138 and handle shell 140 may form a cylinder of round, elliptical, square, polygon, oval or irregular cross-section. In a most preferred embodiment, shell 138 and handle shell 140 are of identical outside shape and are formed from closed-cell polymer foam, thus creating a similar appearance and feel to those of a common "swimming noodle". This emulated swimming noodle may be of any cross-sectional shape, e.g. round, polygonal, elliptical, oval, or some combination of shapes including generally polygonal with rounded sides.

Figure 6:
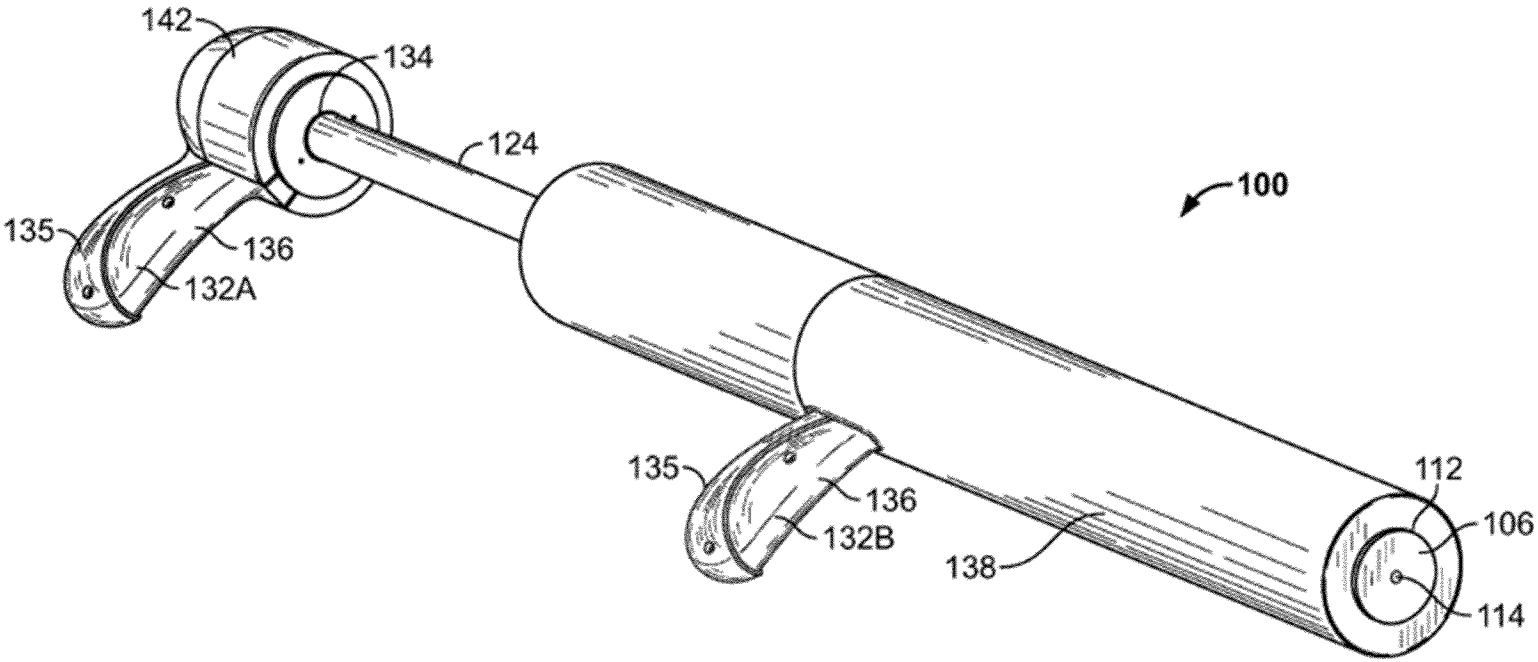
FIG. 6 is a side perspective view of an embodiment of the squirting toy of the present invention.

FIG. 6 shows an alternative embodiment of the present invention. Toy 100 comprises a housing 106 enclosing a chamber 110, the forward end 112 of the housing having a small hole 114. Piston 116 slides within and is sealed against the cylindrical inner surface 120 of the chamber 110. A shaft retainer 142 is connected to shaft 124 at the rearward end 134 thereof. Shaft retainer 142 further comprises a handle 132A. Handle 132A, in a preferred embodiment, is shaped such that it has a palm surface 135 and a finger surface 136, i.e. surfaces molded to receive respective portions of a hand. Gripping handle 132A allows a user to operate shaft 124 and piston 116 as described above.

In a more preferred embodiment, one of either the housing 106 or the shell 138 has a handle 132B extending therefrom. Handle 132B may also have a palm surface 135 and a finger surface 136. Grasping both handle 132A and 132B and forcing them away from one another while hole 114 is below the water surface 104 causes water to be inhaled into the expanding forward chamber portion 110A through hole 114. Subsequent forcing of handles 132A and 132B toward one another causes water in chamber portion 110A to be exhaled through hole 114 in a powerful stream 102.

Figure 7:
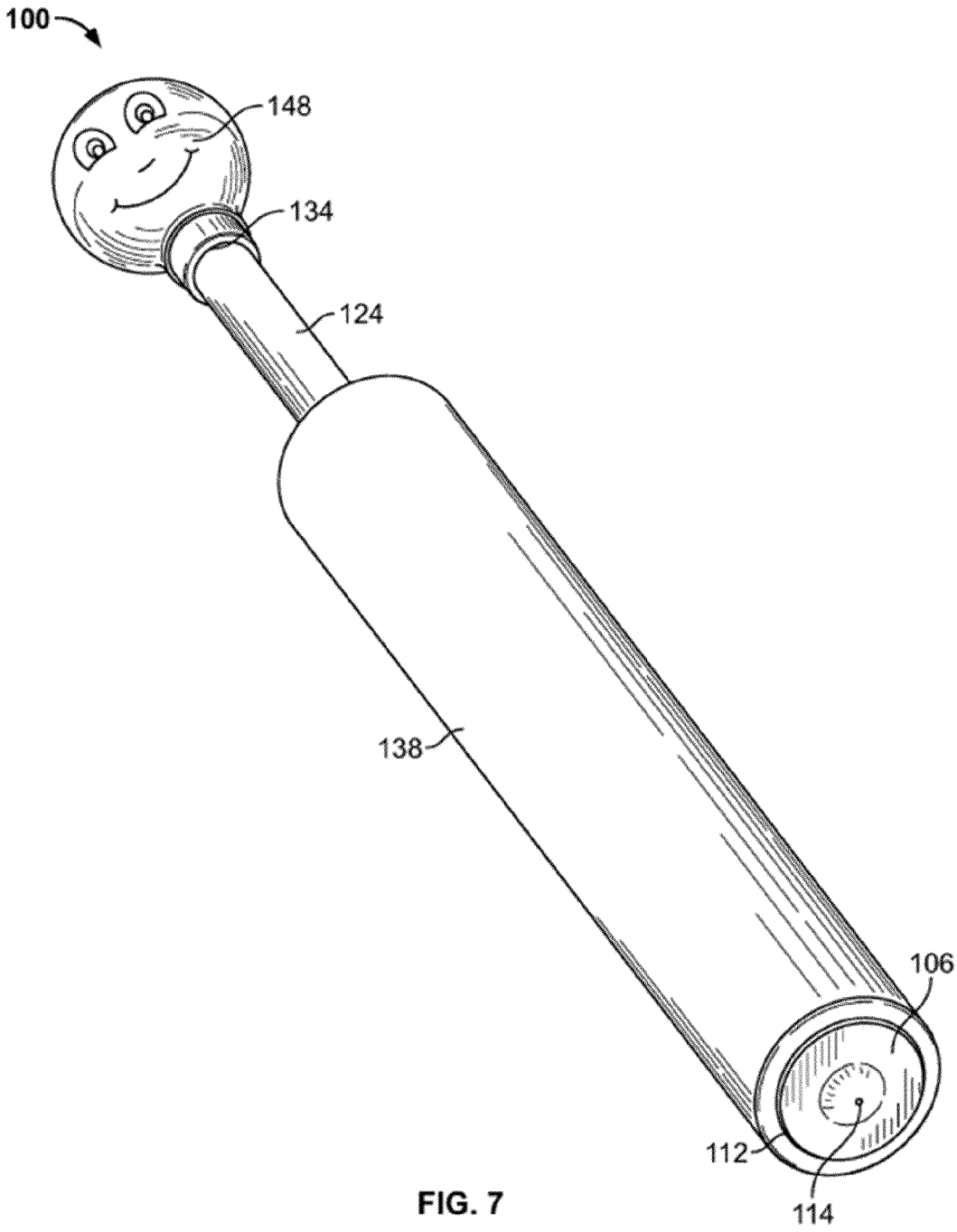
FIG. 7 is a side perspective view of an embodiment of the squirting toy of the present invention.

In another preferred embodiment of the present invention, the handle portion of squirting toy 100 may take a fanciful form. An example is shown schematically in FIG. 7. Examples of the shape of the handle 148 include: an animal head; a cartoon character head; a person's head.

Referring to FIGS. 10-16, in exemplary embodiments, squirting toy 100 can include bellows 160 extending from a region of handle portion 132 and/or handle shell 140 to region of shell 138. Further, bellows 160 can extend from a forward portion 162 to a rearward portion 164 traversing and/or being disposed over at least some of shaft 124, bushing 128, and/or housing 106.

In exemplary embodiments, bellows 160 can provide safety benefits such as blocking a child's fingers from getting caught, pinched, and/or injured when forcing handle portion 132 toward shell 138 to, for example, cause water in chamber 110 to be exhaled from squirting toy 100.

In exemplary embodiments, while being compressed, bellows 160 can store up mechanical energy, for example, like a spring. When no longer applied with compressive force bellows 160 can extend back, elastically recovering and/or substantially elastically recovering, approximately to its prior and/or initial resting position. In exemplary embodiments, this stored mechanically energy can make the squirting toy easier to use by a child and/or this stored mechanically energy can be used to create a pliable barrier that can, amongst other things, substantially prevent a child's fingers from getting caught and/or pinched in the toy during use.

In exemplary embodiments, any number of bellows can be disposed over at least some of shaft 124, bushing 128, and/or housing 106. For example, a single bellows 160 can be disposed over at least some of shaft 124, bushing 128, and/or housing 106. For another example, two or more bellows can couple and/or attach to each other at some point across at least some of shaft 124, bushing 128, and/or housing 106. For yet another example, a first bellows (e.g., extending from a region of handle 132) can couple and/or attach to another element (e.g., body, shell, etc.) and that element can in turn couple and/or attach to a second bellows (e.g., extending from shell 138) such that they collectively can be disposed over at least some of shaft 124, bushing 128, and/or housing 106. For ease, a single bellows is, at times, depicted as being disposed over at least some of shaft 124, bushing 128, and/or housing 106. This is merely for ease and is in no way meant to be a limitation.

In exemplary embodiments, forward portion 162 can be coupled and/or attached to a region of shell 138 and rearward portion 164 can be coupled and/or attached to a region of handle portion 132 and/or handle shell 140. Further, coupling and/or attaching forward portion 162 to a region of shell 138 and reward portion 164 to a region of handle portion 132 and/or handle shell 140 can be accomplished using any reasonable technique such as, but not limited to, as adhesive, glue, epoxy, melting screw means, screw, fastener, and any combination and/or further separation there of, to name a few.

In exemplary embodiments, bellows 160 can be formed from flexible materials that can allow a user, such as a child, to repeatedly and easily collapse and extend the bellows while maintaining its overall shape. In exemplary embodiments, bellows 160 can be formed using plastics and/or polymers, such as, but not limited to, ethylene vinyl acetate (EVA), polypropylene (PP), polyvinyl chloride (PVC), polythene (PE), rubber, and any combination and/or further separation thereof, to name a few. In exemplary embodiments, bellows 160 can be made from a combination of EVA and PP. By way of example, bellows 160 can be made from approximately 75% EVA and 25% PP. By way of another example, bellows 160 can be made from approximately of 70%-80% EVA with 30%-20% PP, 60%-90% EVA with 40%-10% EVA, and 50% EVA with 50% PP.

In exemplary embodiments, bellows 160 can be opaque, transparent, translucent, and/or semi-transparent and/or can allow a user to see the amount of fluid located within chamber 110. In exemplary embodiments, bellows 160 can be at least partially surrounded by additional layer of material, such as foam-like materials described herein.

Figure 15:
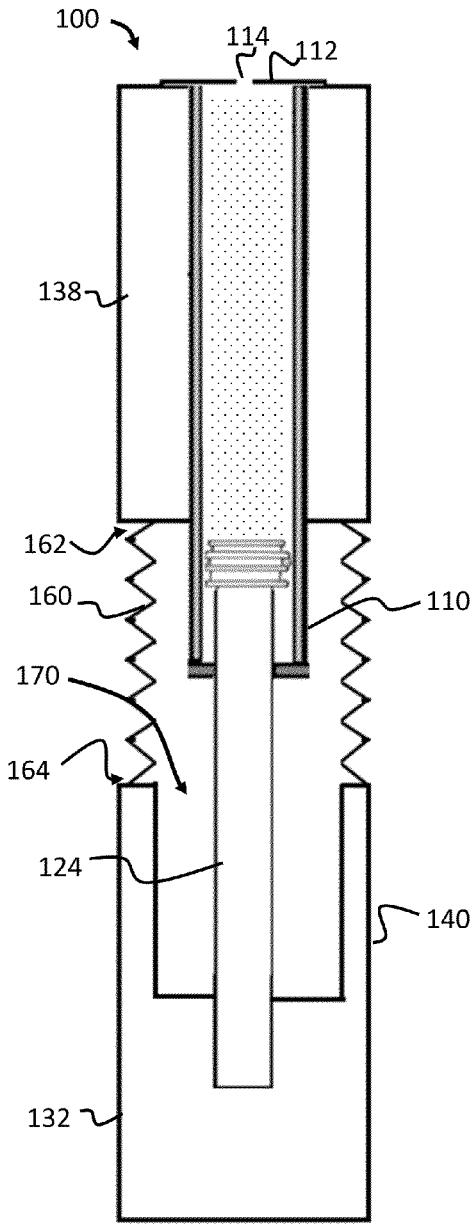
Figure 16:
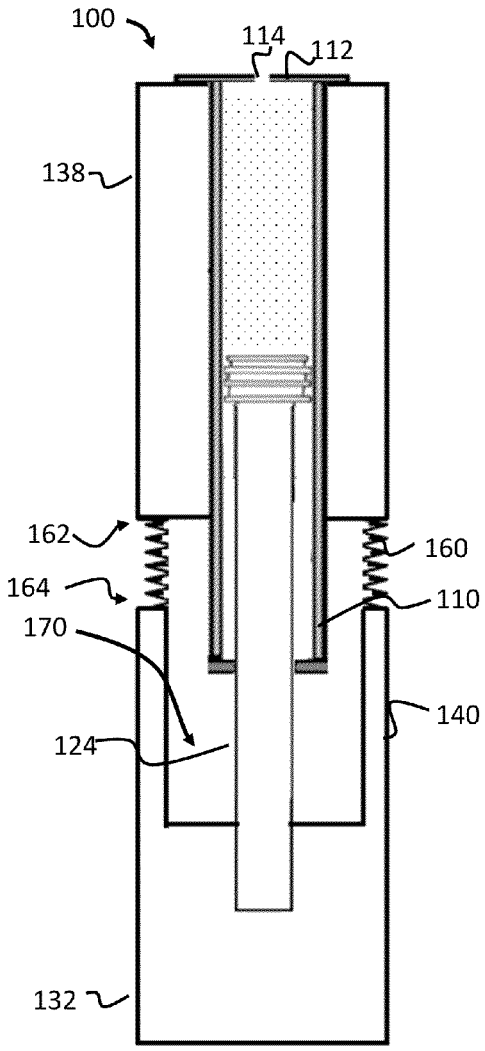

Referring to FIGS. 15-16, in exemplary embodiments, handle portion 132 and/or handle shell 140 can include a receiving region 170 capable of receiving at least some of chamber 110. In exemplary embodiments, the overall compressed length of squirting toy 100 can be reduced by the received amount of chamber 110 in receiving region 170 of handle portion 132 and/or handle shell 140. Utilizing this technique, shipping size can be reduced thereby reducing the cost and environmental impacts affiliated with shipping squirting toys 100. Further, utilizing this technique, the quantity of shelf space and/or storage needed for squirting toy 100 can be reduced.

It will be appreciated by those skilled in the applicable arts that the foregoing is merely one of many possible embodiments of the invention, and that the invention should therefore only be limited according to the following claims.

What is claimed is:

1. A floating squirting toy, comprising:

a housing having a chamber and an opening, the opening allowing fluid communication between the chamber and the outside environment, said chamber comprising an interior wall;

a shaft having a first portion inside of the chamber attached to a piston and a second portion outside of the chamber attached to a handle;

the piston slidably engaged with the interior wall of the chamber adapted for longitudinal movement within the chamber to decrease and increase the volume of the chamber such that when immersed in water the water is inhaled through the opening when the volume increases and exhaled through the opening when the volume decreases;

on at least a portion of at least one of the housing and the handle, an at least one outer shell that provides safety benefits by (i) being constructed of a resilient closed-cell polymer foam material that is substantially soft and (ii) being constructed such that the at least one outer shell contributes to a buoyancy that causes the floating squirting toy to remain afloat when the chamber is completely filled with water; and an at least one bellows extending over at least a portion of at least one of the housing and the shaft.

2. The floating squirting toy of claim 1, wherein the at least one bellows provides safety benefits by blocking a child's fingers from getting caught, pinched, or injured when decreasing the volume of the chamber to exhale water from the floating squirting toy.

3. The floating squirting toy of claim 1, wherein the at least one bellows extends over at least a portion of both the housing and the shaft.

4. The floating squirting toy of claim 1, wherein the at least one bellows extends from at least one of a shell on at least a portion of the housing and the housing to at least one of a shell on at least a portion of the handle.

5. The floating squirting toy of claim 1, wherein the at least one outer shell is constructed of a plurality of substantially soft resilient closed-cell polymer outer shells on a length of at least one of the housing and the handle.

6. The floating squirting toy of claim 1, wherein the at least one substantially soft resilient closed-cell polymer foam outer shell is constructed in a cylindrical shape.

7. The floating squirting toy of claim 1, wherein the at least one cylindrically shaped substantially soft resilient closed-cell polymer foam outer shell has a cross-sectional shape that is at least one of round, polygonal, elliptical, oval, and some combination of shapes including generally polygonal with rounded sides.

8. The floating squirting toy of claim 1, wherein the at least one substantially soft resilient closed-cell polymer foam outer shell is constructed to at least one of the size and shape of an at least one swimming noodle.

9. The floating squirting toy of claim 1, wherein the at least one substantially soft resilient closed-cell polymer foam outer shell is constructed to have a length dimension that is substantially equal to at least one of a length of the housing and a length of the handle.

10. The floating squirting toy of claim 1, wherein the at least one substantially soft resilient closed-cell polymer foam outer shell is constructed to have a length dimension that is substantially smaller than at least one of a length of the housing and a length of the handle.

11. A floating squirting toy, comprising:

a housing having a chamber, the housing comprising an interior surface and an exterior surface, a first end comprising an opening, and a second end comprising an opening;

a piston slidably engaged with the interior surface of the housing and connected to a shaft, the shaft extending from the second end of the housing and comprising a handle portion external to the housing, the piston being adapted for longitudinal movement within the chamber to decrease and increase the volume of the chamber such that when immersed in water the water is inhaled through the first end when the volume increases and exhaled through the first end when the volume decreases;

a soft non-water-absorbing shell disposed over a portion of the external surface of the housing; and an at least one bellows disposed over at least a portion of at least one of the housing and the shaft.

12. The floating squirting toy of claim 11, wherein the at least one bellows provides safety benefits by substantially blocking a child's fingers from getting caught, pinched, or injured when decreasing the volume of the chamber to exhale water from the floating squirting toy.

13. The floating squirting toy of claim 11, wherein the at least one bellows is disposed over at least a portion of both the housing and the shaft.

14. The floating squirting toy of claim 11, wherein the at least one bellows extends from the soft non-water absorbing shell disposed over a portion of the housing to the handle.

15. The squirting toy of claim 11, wherein the soft non-water-absorbing shell is further comprising:

providing buoyancy to keep the toy afloat in water when the housing is filled to its maximum capacity with water;

forming a protective surface over at least a portion of the housing; and whereby the softness of the shell offers safety benefits.

16. The squirting toy of claim 11, wherein the soft non-water-absorbing shell is disposed over substantially the entirety of the housing.

17. The squirting toy of claim 11, further comprising a soft non-water-absorbing shell disposed over a portion of the handle portion.

18. The squirting toy of claim 11, wherein the safety benefits comprise at least one of softness and absence of hard edges.

* * * * *